US010099153B1

(12) United States Patent
Dexter

(10) Patent No.: US 10,099,153 B1
(45) Date of Patent: Oct. 16, 2018

(54) JAWBONE DOLL SYSTEM

(71) Applicant: David A. Dexter, Ruskin, FL (US)

(72) Inventor: David A. Dexter, Ruskin, FL (US)

( * ) Notice: Subject to any disclaimer, the term of this patent is extended or adjusted under 35 U.S.C. 154(b) by 0 days.

(21) Appl. No.: 15/591,264

(22) Filed: May 10, 2017

(51) Int. Cl.
*A63H 3/36* (2006.01)
*A63H 3/00* (2006.01)

(52) U.S. Cl.
CPC ..... *A63H 3/36* (2013.01)

(58) Field of Classification Search
CPC ... A63H 3/00; A63H 3/14; A63H 3/18; A63H 3/28; A63H 3/36; A61L 9/12; A61L 9/042
USPC ..... 446/297, 302, 395, 369; 369/63–65, 68
See application file for complete search history.

(56) References Cited

U.S. PATENT DOCUMENTS 2,933,315 A * 4/1960 Carr, Jr. ..... A63H 23/10 273/140
4,561,854 A * 12/1985 Amici ..... A63H 3/18 446/304
4,778,172 A * 10/1988 Bryan ..... A63H 3/36 446/26
5,447,461 A * 9/1995 Liao ..... A63H 3/14 446/301
6,183,337 B1 * 2/2001 Beckman ..... A63H 3/28 369/65
6,520,826 B2 * 2/2003 Spector ..... A61L 9/12 239/60
6,800,015 B1 * 10/2004 Derges ..... A61L 9/042 239/211

* cited by examiner

*Primary Examiner* — Kien Nguyen

(57) ABSTRACT

A doll is in a configuration to simulate an animal and formed to include a mouth having an opening with upper and lower edges with front edges and side edges. A clasp has an upper component with upper teeth and has a lower component with lower teeth. The upper and lower teeth are fabricated of a synthetic organic compound. The clasp has an upper handle formed as an extension of the upper component and has a lower handle formed as an extension of the lower component. The upper and lower handles are located in an intermediate extent of the doll. A hinge pivotally couples the upper and lower components and a spring urges the handles away from each other while urging the teeth toward each other.

1 Claim, 7 Drawing Sheets

FIG 5
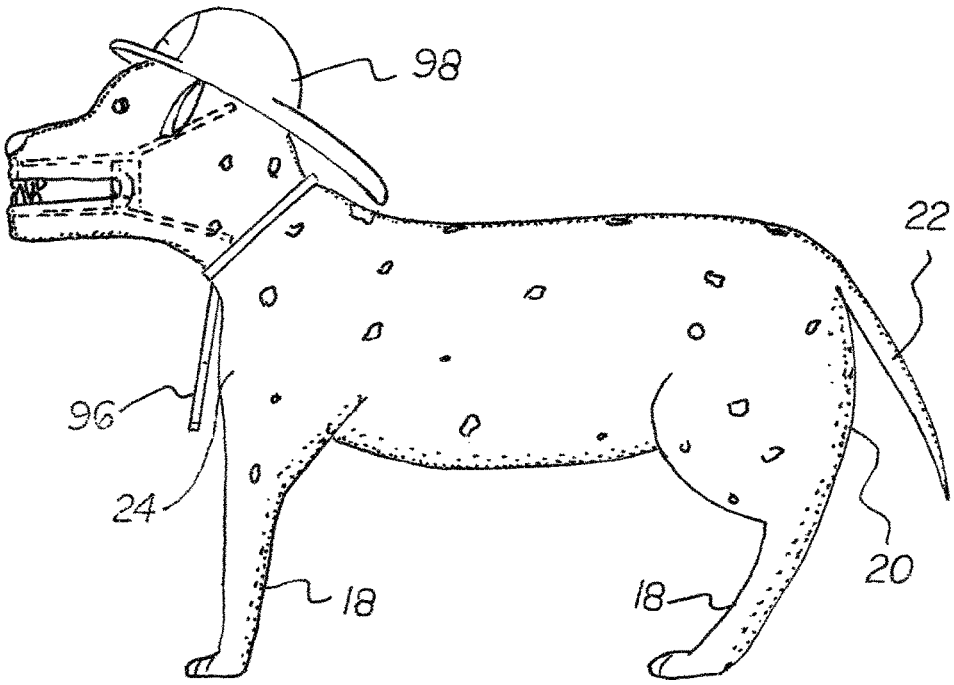
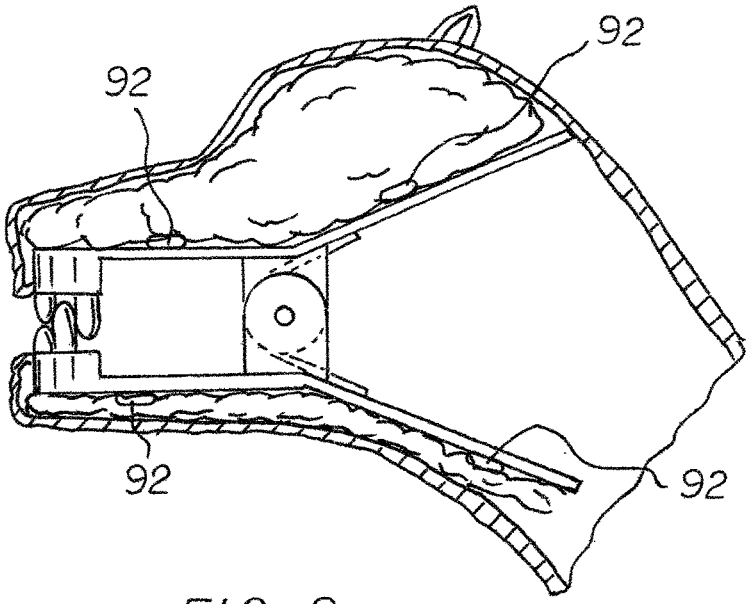
FIG 6

FIG. 7
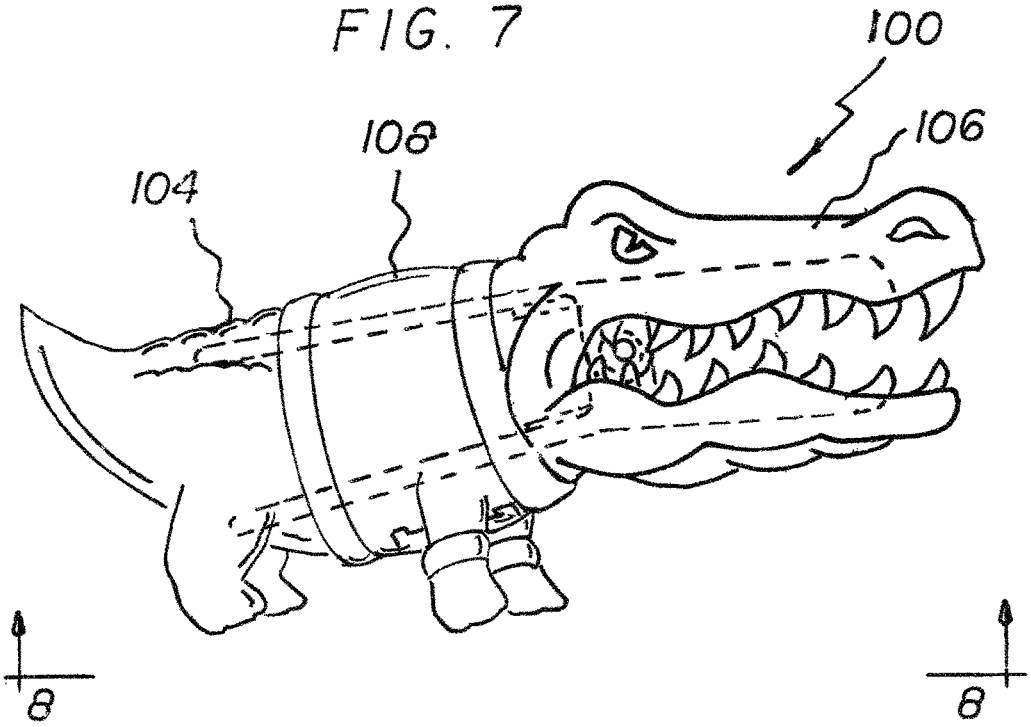
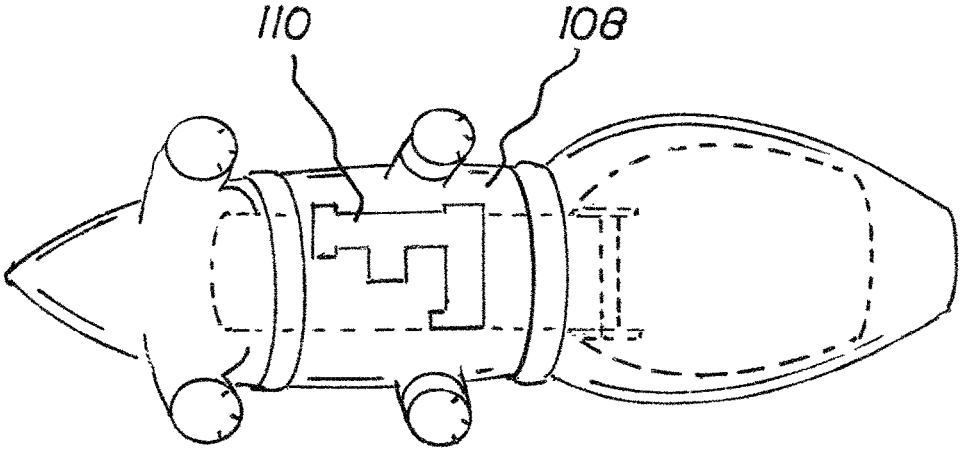
FIG. 8

JAWBONE DOLL SYSTEM

RELATED APPLICATION

The present application is an improvement over my prior application Ser. No. 14/813,978 filed Jul. 30, 2015, now U.S. Pat. No. 9,636,593 issued May 2, 2017, the subject matter of which is incorporated herein by reference.

BACKGROUND OF THE INVENTION

Field of the Invention

The present invention relates to a jawbone doll system and more particularly pertains to grasping and releasably holding objects in a safe, convenient, and economical manner.

SUMMARY OF THE INVENTION

In view of the disadvantages inherent in the known types of clasp systems of known designs and configurations now present in the prior art, the present invention provides an improved jawbone doll system. As such, the general purpose of the present invention, which will be described subsequently in greater detail, is to provide a new and improved jawbone doll system which has all the advantages of the prior art and none of the disadvantages.

To attain this, the present invention essentially comprises a jawbone doll system. First provided is a doll. The doll is fabricated of a pliable material. The doll is provided in a configuration to simulate a pet dog. The doll has a body. The body has four depending legs. The body has a rear. The rear has a tail. The body has a front. The front has a head. The head has a muzzle. The muzzle is provided forwardly. The head has a base. The base is provided rearwardly.

A mouth is provided. The mouth is provided in the muzzle of the doll. The mouth has an opening. The opening has an upper edge. The opening has a parallel lower edge. Each edge is in a generally U-shaped configuration. The opening has a broadly curved front edge. The front edge is provided forwardly. The opening has side edges. The side edges extend rearwardly from the front edge. C-shaped connectors are provided. The C-shaped connectors join the upper and lower edges remote from the front edges. The side edges diverge rearwardly. In this manner an angle of between 5 and 20 degrees is formed. The side edges have essentially equal lengths. The front edges have an essentially equal length. The length of the front edges is between 25 and 75 percent of the length of the side edges.

Provided next is a clasp. The clasp has an upper component. The clasp has a similarly configured lower component. The lower component extends forwardly. The upper component has integrally formed downwardly extending upper teeth. The lower component has upwardly extending integrally formed lower teeth. The upper teeth include short teeth. The short teeth are of an essentially common size. The short teeth are provided along the lower front edge and in the side edges. The lower teeth also include larger longer teeth. The longer teeth are provided at juncture of the front edge and side edges. The lower teeth include short teeth. The short teeth are of an essentially common size. The short teeth are provided along the lower front edge and in the side edges. The lower teeth include larger longer teeth. The longer teeth are provided at the juncture of the front edge and side edges. The longer teeth of the upper and lower components are adapted to contact each other in overlapping relationship. The longer teeth are further adapted to hold the smaller teeth of the upper component in closely spaced proximity to the smaller teeth of the lower component.

The clasp has handles. The handles extend rearwardly. The handles include an upper handle with laterally spaced legs. The upper handle is formed as an extension of the upper component. The handles include a lower handle with laterally spaced legs. The lower handle is formed as an extension of the lower component. The handles are located in the base of the head of the doll. The upper and lower handles diverge equally and oppositely. The upper and lower handles further form an angle of between 20 and 40 degrees. The upper and lower components are essentially parallel when the system is at rest with the upper and lower teeth in contact.

The clasp has a hinge. The hinge pivotally couples the upper component and handle with the lower component and handle. The hinge has laterally spaced upper plates. The upper plates extend downwardly from the upper component and handle. The hinge has laterally spaced lower plates. The lower plates extend upwardly from the lower component and handle. The hinge has pivot pins. The pivot pins couple the upper plates with the lower plates. The hinge also includes coil springs. The center of curvature of the hinge is provided at the pivot pins. The hinge has fingers. The fingers contact the handles. The fingers further urge the handles away from each other while urging the components and teeth toward each other. The handles are adapted to be squeezed together by a user through the application of pressure to the head base from above and from below. In this manner the upper teeth and lower teeth are separated. Also in this manner any object may be received between the upper and lower teeth. Further in this manner the system may be attached to an object between the upper and lower teeth upon the release of pressure from the handles.

Further provided are securement elements. The securement elements are selected from the class of securement elements. The class of securement elements includes stitches and staples and glue. In this manner the upper component and handle are secured from above. Further in this manner the lower component and handle are secured from below to interior components of the doll.

Provided last are supplemental decorations. The supplemental decorations are selected from the class of supplemental decorations. The class of supplemental decorations includes a name tag. The name tag is removably attached to the doll adjacent to a neck region. The class of supplemental decorations further includes a hat. The hat is removably attached to the doll adjacent to a head region.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jawbone doll system which has all of the advantages of the prior art clasp systems of known designs and configurations and none of the disadvantages.

It is another object of the present invention to provide a new and improved jawbone doll system which may be easily and efficiently manufactured and marketed.

It is further object of the present invention to provide a new and improved jawbone doll system which is of durable and reliable constructions.

An even further object of the present invention is to provide a new and improved jawbone doll system which is susceptible of a low cost of manufacture with regard to both materials and labor, and which accordingly is then susceptible of low prices of sale to the consuming public, thereby making such jawbone doll system economically available to the buying public.

Even still another object of the present invention is to provide a jawbone doll system for grasping and releasably holding objects in a safe, convenient and economical manner.

Lastly, it is an object of the present invention to provide a new and improved jawbone doll system. A doll is in a configuration to simulate an animal and formed to include a mouth having an opening with upper and lower edges with front edges and side edges. A clasp has an upper component with upper teeth and has a lower component with lower teeth. The upper and lower teeth are fabricated of a synthetic organic compound. The clasp has an upper handle formed as an extension of the upper component and has a lower handle formed as an extension of the lower component. The upper and lower handles are located in an intermediate extent of the doll. A hinge pivotally couples the upper and lower components and a spring urges the handles away from each other while urging the teeth toward each other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a side elevation of the jawbone doll system shown in FIG. 4.

FIG. 6 is a cross sectional view of the head of the dog illustrated in FIGS. 4 and 5.

FIG. 7 illustrates an alternate embodiment of the invention, wherein the system is an alligator with an enlarged head and an athletic sweater.

FIG. 8 is a bottom view taken along line 8-8 of FIG. 7.

The same reference numerals refer to the same parts throughout the various Figures and the various embodiments of the invention.

DESCRIPTION OF THE PREFERRED EMBODIMENT

Figure 1:
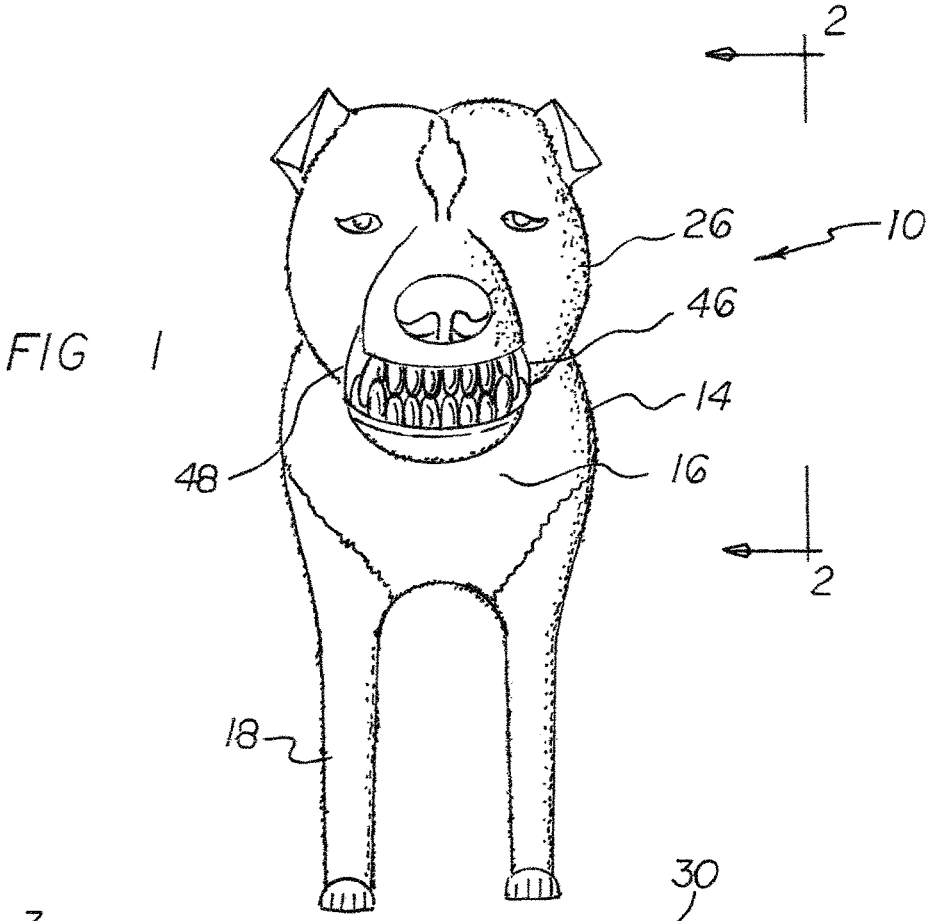
FIG. 1 is a front elevational view of a jawbone doll system constructed in accordance with the principles of the present invention illustrating a pit bull.

With reference now to the drawings, and in particular to FIG. 1 thereof, the preferred embodiment of the new and improved jawbone doll system embodying the principles and concepts of the present invention and generally designated by the reference numeral 10 will be described.

The present invention, the jawbone doll system 10 is comprised of a plurality of components. Such components in their broadest context include a doll and a clasp. Such components are individually configured and correlated with respect to each other so as to attain the desired objective.

First provided is a doll 14. The doll is fabricated of a pliable material. The doll is provided in a configuration to simulate a pet dog. The doll has a body 16. The body has four depending legs 18. The body has a rear 20. The rear has a tail 22. The body has a front 24. The front has a head 26. The head has a muzzle 28. The muzzle is provided forwardly. The head has a base 30. The base is provided rearwardly.

A mouth 34 is provided. The mouth is provided in the muzzle of the doll. The mouth has an opening. The opening has an upper edge 36. The opening has a parallel lower edge 38. Each edge is in a generally U-shaped configuration. The opening has a broadly curved front edge 40, 42. The front edge is provided forwardly. The opening has side edges 44, 46. The side edges extend rearwardly from the front edge. C-shaped connectors 50 are provided. The C-shaped connectors join the upper and lower edges remote from the front edges. The side edges diverge rearwardly. In this manner an angle of between 5 and 20 degrees is formed. The side edges have essentially equal lengths. The front edges have an essentially equal length. The length of the front edges is between 25 and 75 percent of the length of the side edges.

Provided next is a clasp. The clasp has an upper component 54. The clasp has a similarly configured lower component 56. The lower component extends forwardly. The upper component has downwardly extending integrally formed upper teeth 58, 60, 62. The lower component has upwardly extending integrally formed lower teeth 64, 66, 68.

In the primary embodiment, the teeth and the clasp are plastic with the teeth integrally formed with the upper and lower components of the clasp. In an alternate embodiment of the invention, the teeth are of a softer material attached to the clasp components. Such softer teeth material abates the chances of injury as might be caused by the system with harder teeth.

The upper teeth include short teeth 58, 62. The short teeth are of an essentially common size. The short teeth are provided along the upper front edge and in the side edges. The upper teeth also include larger longer teeth 60. The longer teeth are provided at juncture of the front edge and side edges. The lower teeth include short teeth 64, 68. The short teeth are of an essentially common size. The short teeth are provided along the lower front edge and in the side edges. The lower teeth include larger longer teeth 66. The longer teeth are provided at the juncture of the front edge and side edges. The longer teeth 60, 66 of the upper and lower components are adapted to contact each other in overlapping relationship. The longer teeth are further adapted to hold the smaller teeth of the upper component 52, 56 in closely spaced proximity to the smaller teeth of the lower component 64, 68.

The clasp has handles 72, 74. The handles extend rearwardly. The handles include an upper handle 72 with laterally spaced upper legs. The upper handle is formed as an extension of the upper component. The handles include a lower handle 74 formed of laterally spaced lower legs. The lower handle is formed as an extension of the lower component. The handles are located in the base of the head of the doll. The upper and lower handles diverge equally and oppositely. The upper and lower handles further form an angle of between 20 and 40 degrees. The upper and lower components are essentially parallel when the system is at rest with the upper and lower teeth in contact.

The clasp has a hinge 78. The hinge pivotally couples the upper component and handle with the lower component and handle.

The hinge has laterally spaced upper plates 80. The upper plates extend downwardly from the upper component and handle. The hinge has laterally spaced lower plates 82. The lower plates extend upwardly from the lower component and handle. The hinge has pivot pins 84. The pivot pins couple the upper plates with the lower plates. The hinge also includes coil springs 86. The center of curvature of the hinge is provided at the pivot pins. The hinge has fingers 88. The fingers contact the handles. The fingers further urge the handles away from each other while urging the components and teeth toward each other. The handles are adapted to be squeezed together by a user through the application of pressure to the head base from above and from below. In this manner the upper teeth and lower teeth are separated. Also in this manner any object may be received between the upper and lower teeth. Further in this manner the system may be attached to an object between the upper and lower teeth upon the release of pressure from the handles.

Further provided are securement elements 92. The securement elements are selected from the class of securement elements. The class of securement elements includes stitches and staples and glue. In this manner the upper component and handle are secured from above. Further in this manner the lower component and handle are secured from below to interior components of the doll.

The upper component and the lower component each have interior extents within the doll. The upper component and the lower component each have exterior extents outside of the doll. The interior extents are longer that the exterior extents for maximizing leverage.

Provided last are supplemental decorations. The supplemental decorations are selected from the class of supplemental decorations. The class of supplemental decorations includes a name tag 96. The name tag is removably attached to the doll adjacent to a neck region. The class of supplemental decorations further includes a hat 98. The hat is removably attached to the doll adjacent to a head region.

Figure 2:
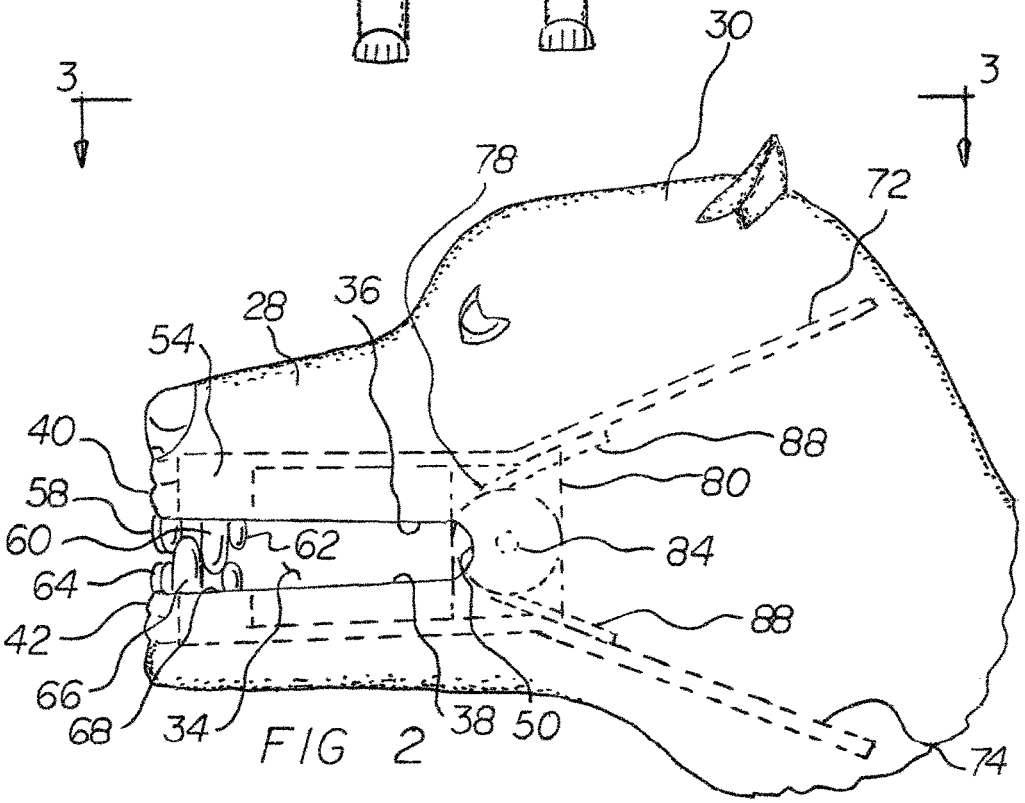
FIG. 2 side elevational view of the system taken along line 2-2 of FIG. 1.
Figure 3:
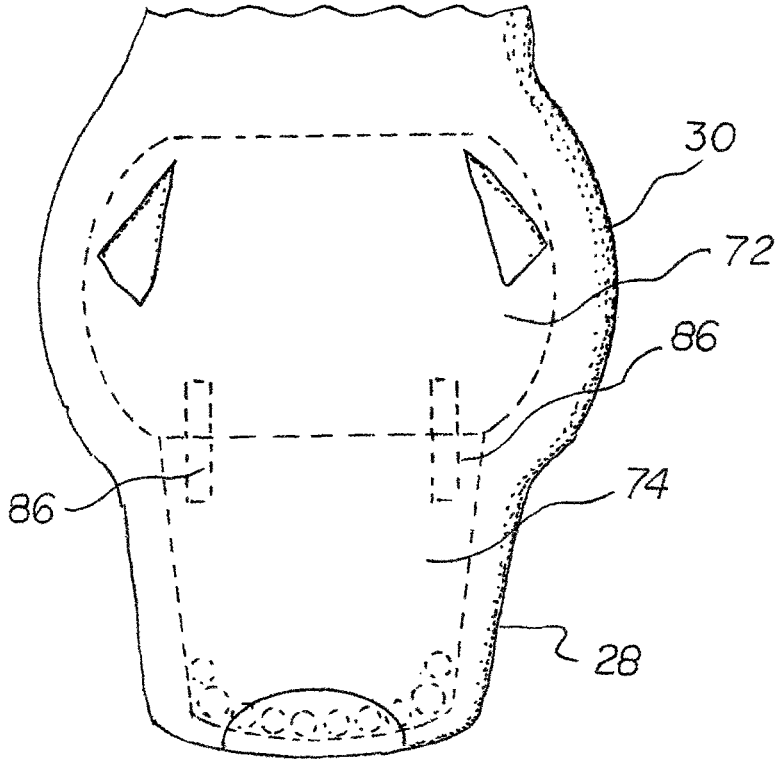
FIG. 3 is a plan view of the system taken along line 3-3 of FIG. 2.
Figure 4:
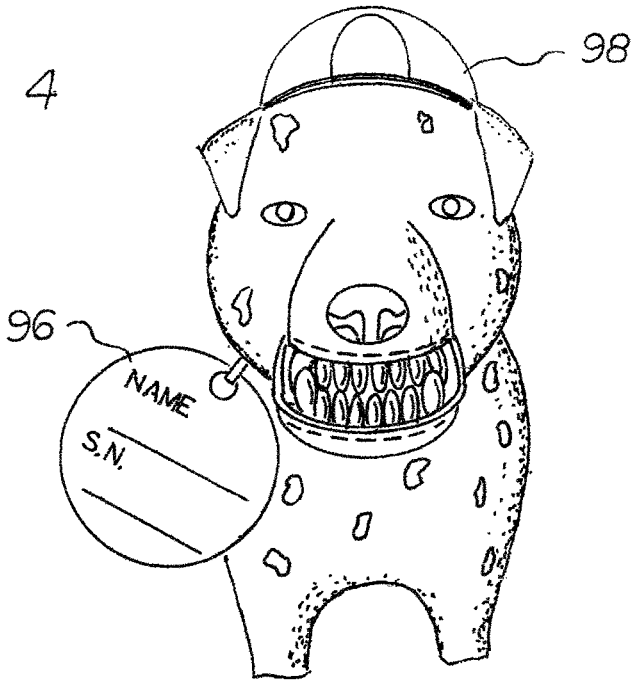
FIG. 4 is a front elevational view of a jawbone doll system constructed in accordance with the principles of the present invention illustrating a dalmatian.

Note is taken that in the embodiment of FIGS. 1, 2 and 3, the upper teeth include short teeth of an essentially common size along the upper front edge and in the side edges with larger longer teeth in the juncture of the front edge and side edges. In contrast to this, in the embodiment of FIGS. 4, 5 and 6, the lower teeth include short teeth of an essentially common size along the lower front edge and in the side edges with larger longer teeth in the juncture of the front edge and side edges, with no short teeth in the side edges.

FIG. 7 illustrates an alternate embodiment of the invention. In such embodiment, the system 100 is an alligator 104 with an enlarged head 106. The system includes a removable athletic sweater 108. FIG. 8 is a bottom view taken along line 8-8 of FIG. 7. The system includes a removable athletic sweater 108. In such view, indicia 110 is formed on the sweater indicative of a preferred athletic team.

Figure 9:
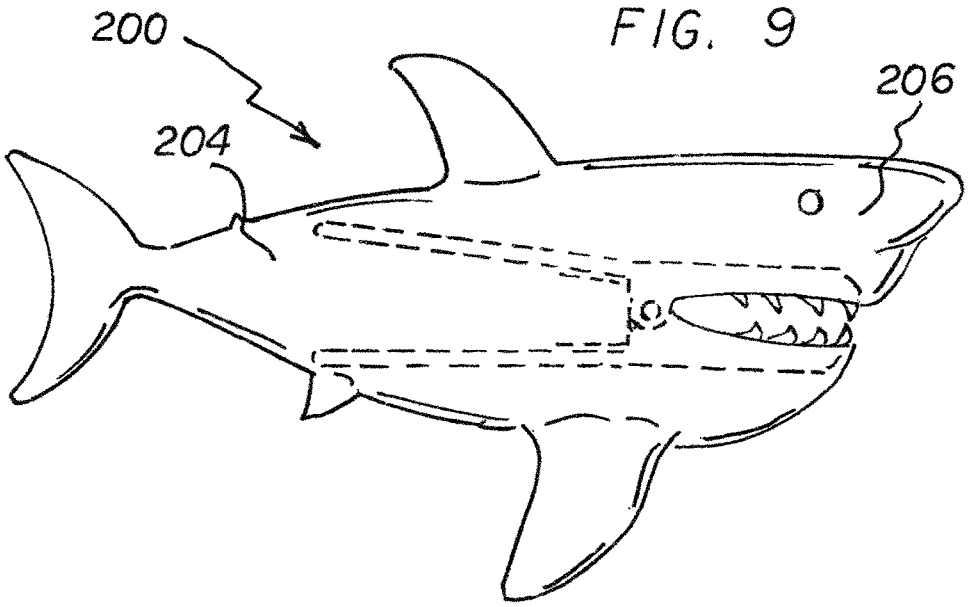
FIG. 9 illustrates another alternate embodiment of the invention, wherein the system is a shark.

FIG. 9 illustrates another alternate embodiment of the invention, wherein the system is a shark. In such embodiment, the system 200 is a shark 204 with an enlarged head 206.

Figure 10:
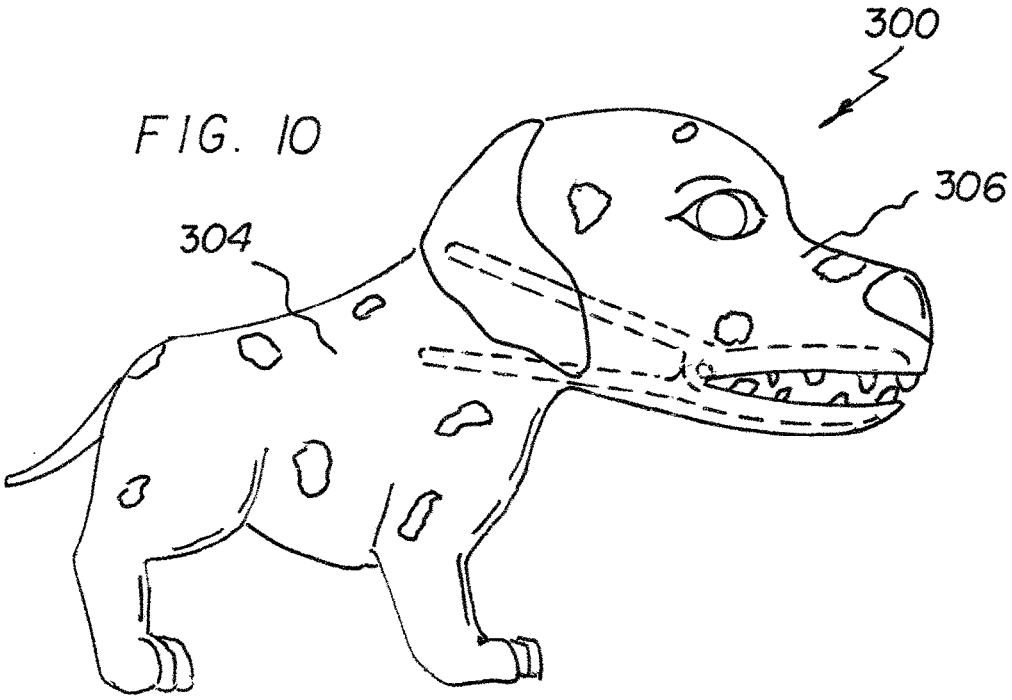
FIG. 10 illustrates an alternate embodiment of the invention, wherein the system is a dog with an enlarged head.

FIG. 10 illustrates another alternate embodiment of the invention, wherein the system 300 is a dog with an enlarged head 306.

Figure 11:
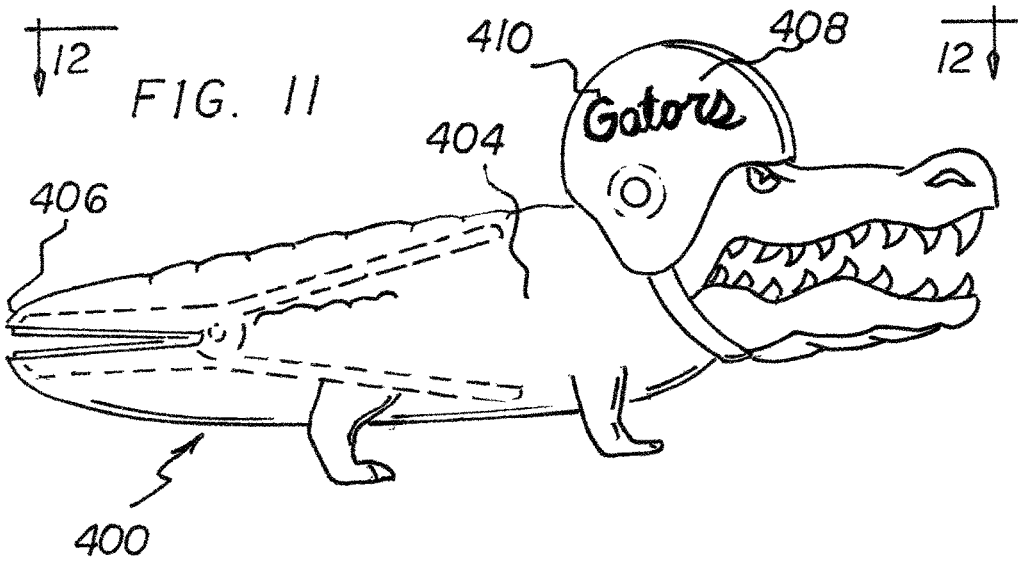
FIG. 11 illustrates a final alternate embodiment of the invention, wherein the system is an alligator with a split tail and an athletic helmet.
Figure 12:
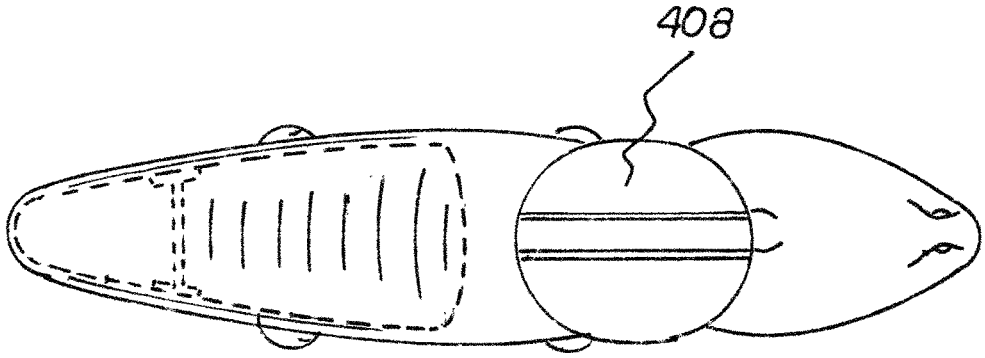
FIG. 12 is a plan view taken along line 12-12 of FIG. 11.
Figure 13:
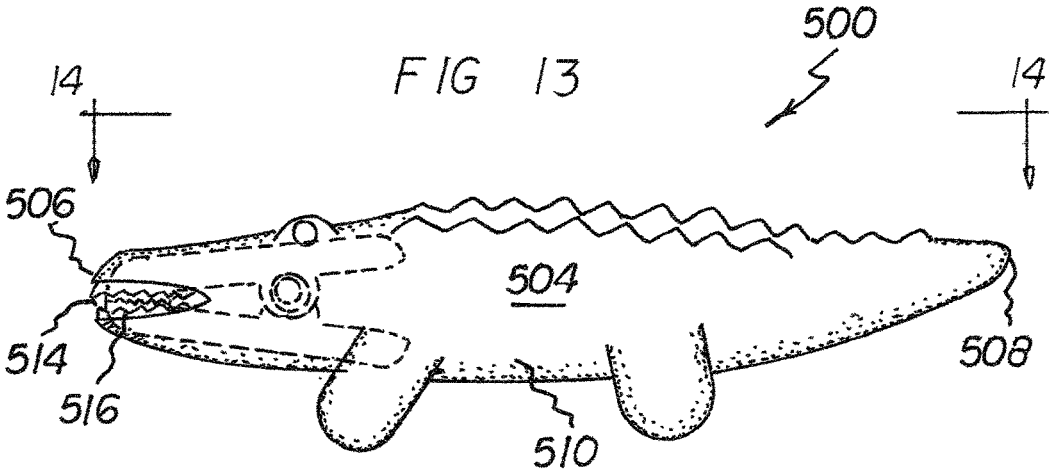
FIG. 13 is a side elevational view of the preferred and primary embodiment of the present invention.
Figure 14:
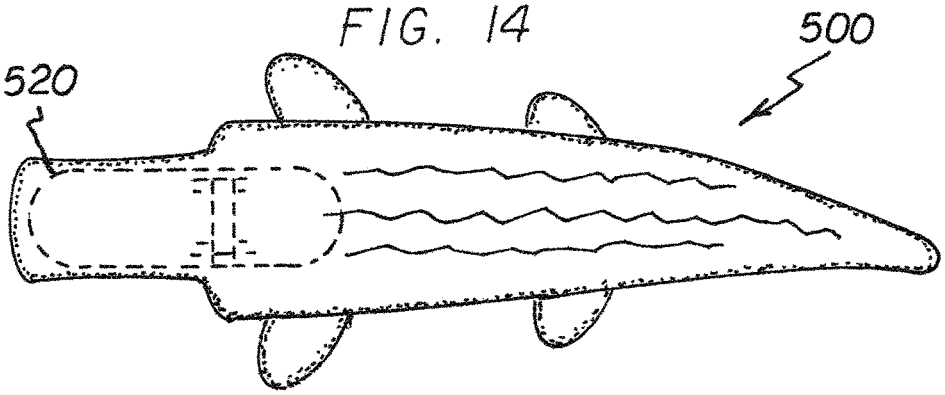
FIG. 14 is a plan view taken along line 14-14 of FIG. 13.
Figure 15:
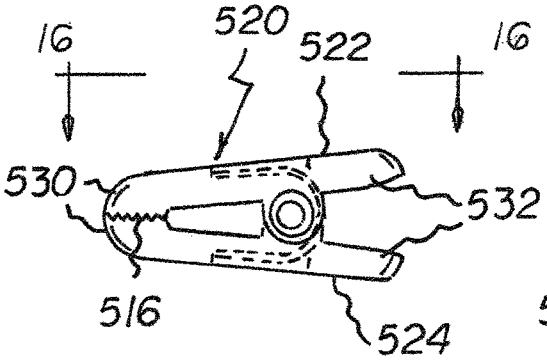
FIG. 15 is a side elevational view of the clip shown in FIGS. 13 and 14.
Figure 16:
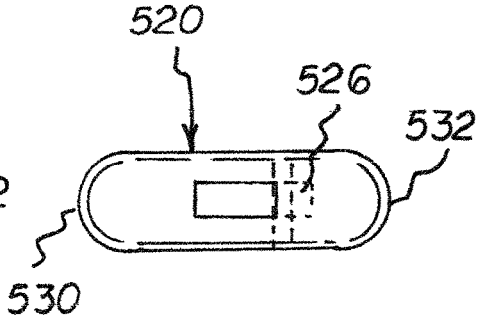
FIG. 16 is a plan view taken along line 16-16 of FIG. 15.

FIG. 11 illustrates a final alternate embodiment of the invention. In such embodiment, the system 400 is an alligator 404 with a split tail 406 for holding objects. The system includes a removable athletic helmet 408. FIG. 12 is a plan view taken along line 12-12 of FIG. 11. Indicia 410 is formed on the helmet indicative of a preferred athletic team.

FIGS. 13-16 illustrate the primary and preferred embodiment of the invention. In such embodiment, the system 500 is for grasping and releasably holding onto objects. The doll is fabricated of a pliable material in a configuration to simulate an animal. The doll has a body with appendages. The doll has a forward end 506 formed forwardly. The doll has a rearward end 508 formed rearwardly. The doll has an intermediate extent 510 between the forward end and the rearward end. The doll is fabricated with a fragrance.

A mouth 514 is formed in the forward end of the doll. The mouth has teeth 516. The mouth has a length extending rearwardly from the forward end. The clasp is fabricated of a first plastic and the teeth are fabricated of a second plastic different from the first plastic. The teeth are preferably fabricated of polybutadiene rubber.

Further in the preferred embodiment, the system includes a tag separably coupled to the doll.

A clasp 520 has an upper component 522 and a similarly configured lower component 524. A hinge with a coil spring 526 is located between the upper component and the lower component. The hinge with the spring couples together the upper component and the lower component. The upper component has integrally formed downwardly extending upper teeth. The lower component has integrally formed upwardly extending lower teeth.

The clasp has graspers 530 extending forwardly. The clasp has handles 532 extending rearwardly. The graspers are located in the mouth of the doll. The handles are located in the intermediate extent of the doll. The clasp forwardly of the hinge and coil spring are of a length greater than the mouth length. The coil spring urges the handles away from each other while urging the components and teeth toward each other. The graspers adjacent to the forward end are in a hemispherical configuration when the teeth are in contact with each other. The handles are adapted to be squeezed together by a user through the application of pressure to the head base from above and from below to separate the upper teeth and lower teeth for the receipt of any object between the upper and lower teeth and for attaching the system to an object between the upper and lower teeth upon the release of pressure from the handles.

The jawbone dolls of the present invention may be made of a wide variety of materials such as an exterior of natural and/or synthetic fibers including blends thereof. Typical materials include plain cloth and pile textiles such as plush and terrycloth. Terrycloth is the preferred material for the exterior. The interior or stuffing material may be made from cotton, straw, wood, wool, plastic pellets, beans or synthetic fiber batting. Synthetic fiber batting is the preferred stuffing material. The synthetic fiber batting fills the space within the exterior terrycloth except for the space between the upper and lower handles whereby the handles may move toward and away from each other to open and close the teeth. In an alternate embodiment of the invention, a fragrance emitting substance is added to the stuffing material to maximize the appeal of the system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jawbone doll system (500) for grasping and releasably holding onto objects consisting of:

a doll (504) fabricated of a pliable material in a configuration to simulate an animal, the doll having a body with appendages, the doll having a forward end (506) formed forwardly, the doll having a rearward end (508) formed rearwardly, the doll having an intermediate extent (510) between the forward end and the rearward end, the doll having a head base, the doll being fabricated with a fragrance;

a mouth (514) formed in the forward end of the doll, the mouth having teeth (516) fabricated of a plastic, polybutadiene rubber, the mouth having a mouth length extending rearwardly from the forward end;

a clasp (520) having an upper component (522) and a similarly configured lower component (524), the upper component being linear, the lower component being linear, a hinge with a coil spring (526) located between the upper component and the lower component, the hinge with the spring coupling together the upper component and the lower component, the upper component having integrally formed downwardly extending upper teeth, the lower component having integrally formed upwardly extending lower teeth;

the clasp having graspers (530) extending forwardly, the clasp having handles (532) extending rearwardly, the graspers being longer than the handles, the graspers being located in the mouth of the doll, the handles being located in the intermediate extent of the doll, the clasp forwardly of the hinge and coil spring being of a length greater than the mouth length, the coil spring urging the handles away from each other while urging the components and teeth toward each other, the graspers adjacent to the forward end being in a hemispherical configuration when the teeth are in contact with each other, the handles adapted to be squeezed together by a user through the application of pressure to the head base from above and from below to separate the upper teeth and lower teeth for the receipt of any object between the upper and lower teeth and for attaching the system to an object between the upper and lower teeth upon the release of pressure from the handles.

* * * * *